US009623686B2

(12) United States Patent
Ishizuka

(10) Patent No.: US 9,623,686 B2
(45) Date of Patent: Apr. 18, 2017

(54) RECORDING APPARATUS AND RECORDING METHOD

(71) Applicant: SEIKO EPSON CORPORATION, Tokyo (JP)

(72) Inventor: Hirotaka Ishizuka, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/601,974

(22) Filed: Jan. 21, 2015

(65) Prior Publication Data

US 2015/0231904 A1 Aug. 20, 2015

(30) Foreign Application Priority Data

Feb. 20, 2014 (JP) ..... 2014-030801

(51) Int. Cl.
*B41J 15/04* (2006.01)
*B41J 3/407* (2006.01)
*D06P 5/30* (2006.01)

(52) U.S. Cl.
CPC ..... *B41J 15/04* (2013.01); *B41J 3/4078* (2013.01); *B41J 15/048* (2013.01); *D06P 5/30* (2013.01)

(58) Field of Classification Search
CPC ... B41J 2/01; B41J 15/04; B41J 3/4078; B41J 15/048; D06P 5/30
USPC ..... 347/104
See application file for complete search history.

(56) References Cited

U.S. PATENT DOCUMENTS

| | | | | |
|---|---|---|---|---|
| 5,805,191 | A * | 9/1998 | Jones | B41J 2/005 347/103 |
| 6,375,293 | B1 * | 4/2002 | Endo | 347/2 |
| 8,109,597 | B2 * | 2/2012 | Hori | 347/23 |
| 2008/0016630 | A1 | 1/2008 | Grasselli | |
| 2015/0054885 | A1 * | 2/2015 | Sugiyama | 347/21 |
| 2015/0070431 | A1 * | 3/2015 | Nakamura | 347/16 |

FOREIGN PATENT DOCUMENTS

| | | | |
|---|---|---|---|
| JP | 08-302576 | A | 11/1996 |
| JP | 2010-106374 | A | 5/2010 |
| JP | 2010-143175 | A | 7/2010 |
| JP | 2011-006805 | A | 1/2011 |
| JP | 2011006805 | A * | 1/2011 |
| KR | 10-2008-0061028 | * | 1/2010 |
| KR | 100944803 | B1 * | 3/2010 |

OTHER PUBLICATIONS

The Extended European Search Report for the corresponding European Application No. 15155868.1 dated Aug. 6, 2015.

* cited by examiner

*Primary Examiner* — Julian Huffman
*Assistant Examiner* — Michael Konczal
(74) *Attorney, Agent, or Firm* — Global IP Counselors, LLP

(57) ABSTRACT

A recording apparatus includes an adhesive belt having adhesion to peelably affix a recording medium, a liquid ejection unit configured to eject a liquid for forming an image onto a recording medium supported by the adhesive belt from a nozzle array, and a peeling liquid adhesion unit configured to adhere a peeling liquid onto the recording medium.

9 Claims, 4 Drawing Sheets

RECORDING APPARATUS AND RECORDING METHOD

CROSS-REFERENCE TO RELATED APPLICATIONS

This application claims priority to Japanese Patent Application No. 2014-030801 filed on Feb. 20, 2014. The entire disclosure of Japanese Patent Application No. 2014-030801 is hereby incorporated herein by reference.

BACKGROUND

Technical Field

The present invention relates to a recording apparatus and a recording method.

Related Art

Conventionally, a recording apparatus that is used has a recording medium affixed to and supported by an adhesive belt for transport, and ink ejected from a recording head to record onto the recording medium.

Disclosed is the coating of a bonding agent that peelably affixes the recording medium to the support surface of the recording medium onto the adhesive belt.

Japanese Laid-Open Patent Publication No. H08-302576 discloses an apparatus in which a bonding agent referred to as an adhesive agent is uniformly coated on the top surface of a transport belt.

Here, when recording to a recording medium affixed by, for example, a pressure roller to the adhesive belt, differences sometimes arise in the penetration of ink at the interface of the adhesive belt and the recording medium. When there is a difference in ink penetration at the interface of the adhesive belt and the recording medium, a difference is produced in the adhesive force between the adhesive belt and the recording medium. More specifically, during recording, parts with a low ink ejection volume tend to have higher adhesive force than parts having a high ink ejection volume.

Therefore, when the cloth is peeled off after recording, places having a high adhesive force become difficult to partially peel off. In particular, the problem was that when the recording medium is cloth, the parts that were difficult to peel would stretch.

SUMMARY

Therefore, an objective of the present invention is to prevent the creation of a difference in the adhesive force caused by the difference in the ink ejection volume for the recording medium, and the difficulty in partial peeling when recording to a recording medium affixed to an adhesive belt and then peeling the recording medium from the adhesive belt after recording.

To solve the above problems, the recording apparatus related to a first embodiment of the invention is provided with an adhesive belt that has adhesion to peelably affix a recording medium, a liquid ejection unit configured to eject a liquid for forming an image from a nozzle array onto the recording medium supported by the adhesive belt, and a peeling liquid adhesion unit configured to adhere the peeling liquid onto the recording medium.

A recording apparatus related to a second embodiment of the invention is the first embodiment in which the peeling solution adhesion unit is configured to eject the peeling liquid from the nozzle array.

A recording apparatus related to a third embodiment of the invention is the second embodiment in which a control unit configured to control operations of the liquid ejection unit and the peeling liquid adhesion unit is provided. The control unit is configured to control such that a total volume of liquid that combines a volume of liquid ejected per unit area of the recording medium from the liquid ejection unit and a peeling liquid volume from the peeling liquid adhesion unit becomes a predetermined volume.

A recording apparatus related to a fourth embodiment of the invention is any one of the first embodiment to the third embodiment in which the peeling liquid adhesion unit is configured to adhere the peeling liquid onto the recording medium after the recording medium has been supported by the adhesive belt.

A recording apparatus related to a fifth embodiment of the invention is any one of the first embodiment to the third embodiment in which the peeling liquid adheres to a part outside of a liquid ejection region.

A recording apparatus related to a sixth embodiment of the invention is any one of the first embodiment to the fifth embodiment in which the peeling liquid adheres to at least a side edge of the recording medium.

A recording apparatus related to a seventh embodiment of the invention is any one of the first embodiment to the sixth embodiment in which the peeling liquid includes water and a surfactant.

A recording method related to an eighth embodiment of the invention is provided with adhering a peeling liquid to a recording medium and ejecting liquid onto the recording medium supported by an adhesive belt to form an image.

According to the invention, when a liquid for forming an image on a recording medium affixed to an adhesive belt is ejected for recording, and the recording medium is peeled from the adhesive belt after recording, the development of a difference in the adhesive force due to the difference in the volume of liquid ejected onto the recording medium and the difficulty in partially peeling can be prevented.

BRIEF DESCRIPTION OF THE DRAWINGS

Referring now to the attached drawings which form a part of this original disclosure:

FIG. 4A is the case in which the density of the image to be formed is constant, and FIG. 4B is the case in which the image to be formed has a grayscale.

DETAILED DESCRIPTION OF EXEMPLARY EMBODIMENTS

A recording apparatus related to a working example of the present invention is explained below with reference to the attached drawings. However, the present invention is not limited to these examples.

Example 1

Figure 1:
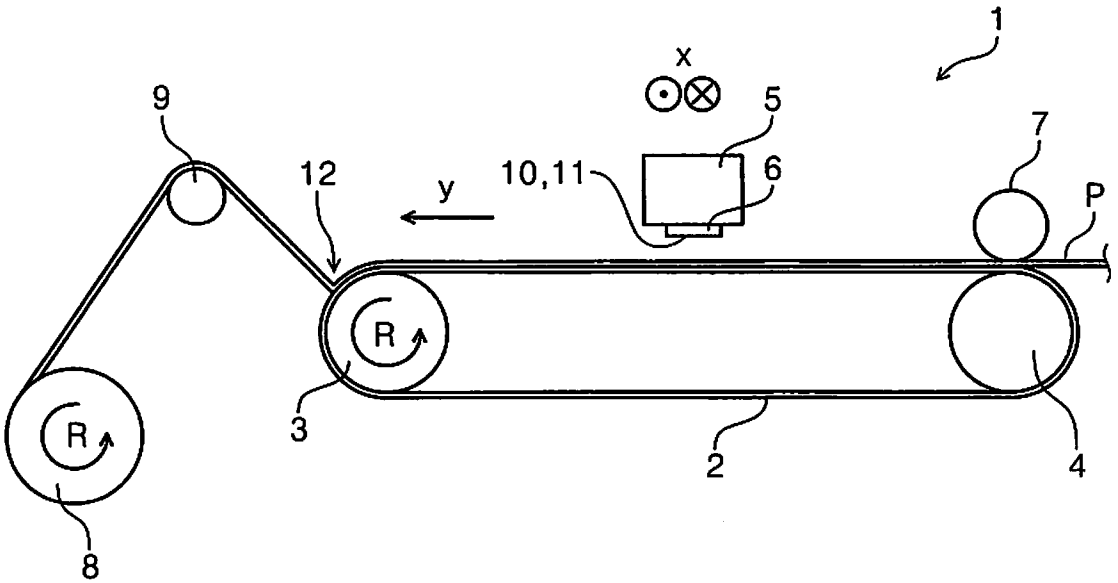
FIG. 1 is a schematic side view showing a recording apparatus related to an embodiment of the present invention.
Figure 2:
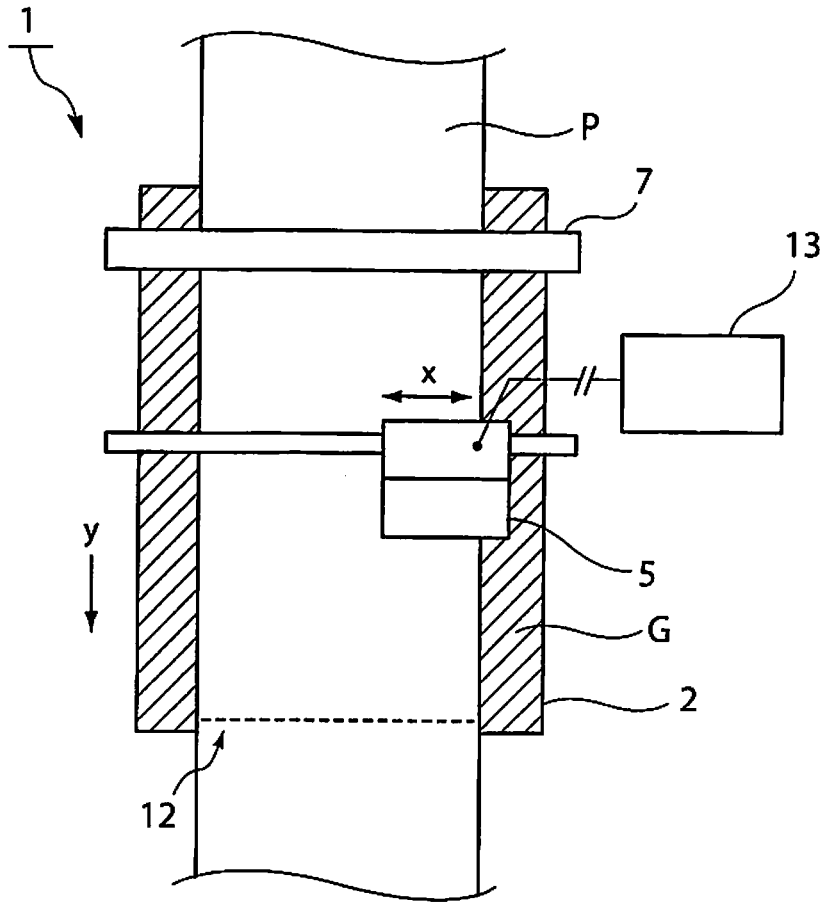
FIG. 2 is a schematic plan view of a recording apparatus related to an embodiment of the present invention.

FIG. 1 is a schematic side view showing a recording apparatus 1 related to a working example of the present invention. FIG. 2 is a schematic plan view of the recording apparatus 1 related to a working example of the present invention.

The recording apparatus 1 in this working example is provided with an adhesive belt 2 that peelably affixes and supports a recording medium P and transports in the transport direction y.

In this specification, "adhesive belt" means a belt in which an adhesive agent is coated on a support surface G of the recording medium P, and the support surface G has adhesiveness for peelably affixing the recording medium P.

In the adhesive belt 2, adhesion for peelably affixing the recording medium P is imparted by coating a known coating agent, a so-called "adhesive agent," onto the support surface G of the recording medium P.

The adhesive belt 2 is stretched on a drive roller 3 and a following roller 4 that rotate in direction of rotation R. The recording apparatus 1 of this working example is provided with the two rollers of the drive roller 3 and the following roller 4, but 3 or more rollers may be provided, and a plurality of these may be drive rollers.

In addition, an adhesive roller 7 is provided at a position opposite the following roller 4. The adhesive roller 7 is oriented toward the following roller 4. The recording medium P is continuously pressed on and sandwiched between the adhesive roller 7 and the adhesive belt 2 above the following roller 4 to affix to the adhesive belt 2.

In addition, in the recording apparatus 1 of this working example, an ejection head 6 provided with a liquid ejection unit 10 that ejects ink as the liquid for forming an image from a nozzle array and a peeling liquid adhesion unit 11 that ejects a peeling liquid D are arranged in the transport path of the recording medium P by the adhesive belt 2.

Figure 3A:
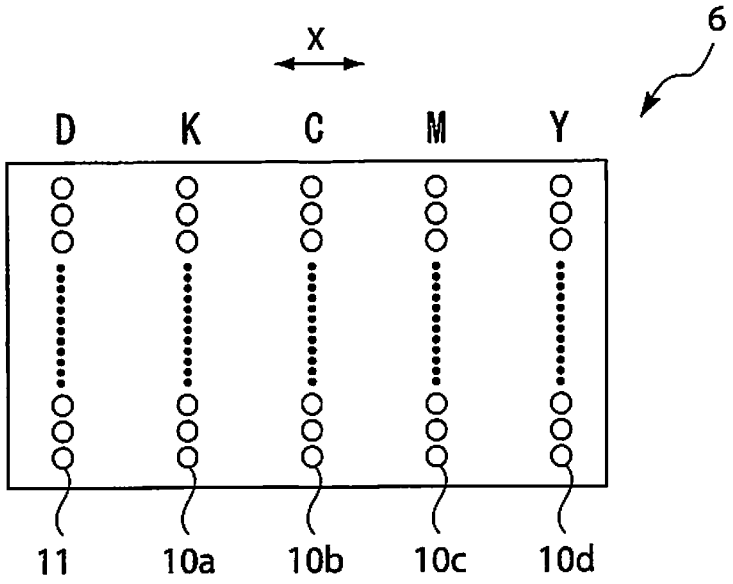
FIG. 3A is a plan view showing one example of an ejection head that is used in the recording apparatus related to an embodiment of the present invention.

As shown in FIG. 3A, the liquid ejection unit 10 of the ejection head 6 comprises nozzle array 10*a*, nozzle array 10*b*, nozzle array 10*c*, and nozzle array 10*d* that eject each of the colored inks (e.g., yellow (Y), magenta (M), cyan (C), black (K)). In addition, the peeling liquid adhesion unit 11 is composed of a peeling liquid nozzle array 11*a*.

For example, an inkjet recording apparatus is given as this kind of recording apparatus 1.

After ink is ejected from the liquid ejection unit 10 to form an image, the recording medium P is peeled from the adhesive belt 2 at the peeling position 12 that is within a predetermined range on the downstream side of the adhesive belt 2 and is wound by a winding unit 8 rotating in the direction of rotation R via a following roller 9 fixed at a predetermined position. The recording medium P is not limited to roll paper; naturally, any medium compatible with the recording apparatus 1 that uses standard paper is acceptable.

In this specification, "downstream" is the direction in which the recording medium is transported in the recording apparatus, and the opposite direction thereto is "upstream."

Additionally, "inks" include colorings and are liquids that are capable of forming images by fixing to the recording medium P.

The recording apparatus 1 is able to eject inks onto the recording medium from nozzle arrays 10*a*, 10*b*, 10*c*, 10*d* of the liquid ejection unit 10 to form the desired image while the ejection head 6 moves with reciprocating motion in the direction x that intersects the transport direction y by a carriage 5. In addition, the peeling liquid D ejected from peeling liquid nozzle array 11*a* of the peeling liquid adhesion unit 11 can also be affixed to the recording medium P by reciprocating motion of the ejection head 6.

In this specification, "peeling liquid" is a liquid that adheres to the recording medium P supported by the adhesive belt 2 and imparts peelability to the adhesive belt 2.

The peeling liquid D is preferably a nearly colorless liquid that does not cause chemical changes when mixed with the liquids for forming images (inks in recording apparatus 1) and does not have a visual effect even when adhering to the recording medium P.

For example, liquids that have water as the main ingredient and contain a surfactant can be used.

Nonionic surfactants, anionic surfactants, amphoteric surfactants are given as the surfactant. In particular, nonionic surfactants are preferably used. For example, known surfactants such as acetylene glycol, acetylene alcohol, ethylene glycol, and polyhydric alcohol can be used as the nonionic surfactant.

The surfactant contained in the peeling liquid D may include a plurality of surfactants.

Liquids composed of nearly the same ingredients as ink except for not containing colorings can be used as the peeling liquid D.

The composition of the inks differs depending on the type of recording medium P and, for example, when an image will be formed on cloth, in addition to including water as the solvent and the main component, may include colorings, surfactants, humectants, antiseptic agents, chelating agents, as well as functional additives such as antifoaming agents and the like.

According to this working example, because the peeling liquid adhesion unit 11 that affixes the peeling liquid D to the recording medium P is provided, the volume of ink ejected for the recording medium P differs in each part of the recording medium P when an image is formed from ink. It is possible to adhere the peeling liquid D to parts having small ejection volumes of ink when in a state that has a distribution of parts with a large volume of ejected ink and parts with a small volume.

By affixing the peeling liquid D to parts with a small ejection volume of ink, the difference in the coating volume of the "liquid" in parts with large volumes and parts with small volumes can be reduced.

Thus, at the interface of the adhesive belt 2 and the recording medium P, concern is reduced about creating parts with different states of penetration of the "liquid." Consequently, concern can be lessened about a difference developing between the adhesive force between the adhesive belt 2 and the recording medium P.

After image formation using ink, when the recording medium P is peeled from adhesive belt 2 at the peeling position 12, difficulty in partial peeling caused by the differences in the ejection volume of ink in the recording medium P can be prevented.

In this specification, "liquid" is used as the general term for the liquid state as one of the three states of matter.

In this working example, the peeling liquid adhesion unit 11 is constituted to eject by a nozzle array similar to the liquid ejection unit that ejects ink. When the same ejection structure is set for the ink and the peeling liquid D, preferably, the ink and the peeling liquid D can be ejected in a state similar to droplets and adhere to the recording medium P.

In this working example, the liquid ejection unit 10 and the peeling liquid adhesion unit 11 are arranged in the same ejection head 6. The configuration is such that after the recording medium P is supported by the adhesive belt 2, the peeling liquid D adheres to the recording medium P on the adhesive belt 2.

According to this configuration, the peeling liquid D adheres to the recording medium P supported by the adhesive belt 2. The peeling liquid D can adhere in the same support state as the recording medium when ink ejected by the liquid ejection unit 10 is adhered. In addition, the recording medium P easily adheres to the adhesive belt 2 before the peeling liquid D adheres.

In addition, other than the case when the liquid ejection unit 10 and the peeling liquid adhesion unit 11 are arranged in the same ejection head 6, each can be arranged in a separate ejection head. For example, the ejection head for the peeling liquid adhesion unit 11 is on the transport path due to the adhesive belt 2, and can be arranged either further on the upstream side or the downstream side of the ejection head for the liquid ejection unit 10.

In addition, the peeling liquid D can be adhered in advance to the recording medium P before the recording medium P is supported by the adhesive belt 2.

In addition, the recording apparatus 1 of the working example is provided with an ejection head 6 for recording while in reciprocating motion is provided, but may be a recording apparatus that is provided with a so-called line head equipped with a plurality of nozzles for ejecting ink in a direction that intersects the transport direction y.

Here, the "line head" is a recording head in which the area of the nozzle formed in the intersecting direction that intersects the transport direction y of the recording medium P is arranged to enable covering the entire intersecting direction of the recording medium P, and one of either the recording head or the recording medium is fixed and the other is moved to form the image.

From control unit 13 (see FIG. 2), the recording apparatus 1 is configured to control the ejection of the ink ejected from the ink nozzle arrays 10*a*, 10*b*, 10*c*, 10*d* arranged in the ejection head 6 and the peeling liquid D ejected from the peeling liquid nozzle array 11*a*.

Here, a control unit 13 controls so that the total volume of liquid that combined the volume of ink ejected from the ink nozzle arrays 10*a*, 10*b*, 10*c*, 10*d* that is ejected per unit area of the recording medium P and the ejection volume of peeling liquid D from the peeling liquid nozzle array 11*a* become the predetermined volume.

Thus, because the penetration state of the "liquid" at the interface between the adhesive belt 2 and the recording medium P can uniformly cover the entire region of the interface, concern can be lessened about a difference developing in the adhesive force between the adhesive belt 2 and the recording medium P. Thus, after the image is formed from the ink, when the recording medium P is peeled from the adhesive belt 2 at the peeling position 12, concern can be lessened about difficulty in partial peeling due to the differences of the ejection volume of ink onto the recording medium P.

The total volume of liquid ejected per unit area in the entire recording medium P "becomes the predetermined volume" and is not restricted to being completely identical volumes at any of the locations on the recording medium P, and means that the adhesive force between the adhesive belt 2 and the recording medium P become nearly equal and includes the range in which a difference is not produced in the ease of peeling.

Control by the control unit 13 is explained in more detail with reference to FIGS. 4A and 4B.

The recording apparatus 1 forms an image in the region in which ink was ejected (hereinafter, referred to as—the ink ejection region 14). FIG. 4A shows the case in which the density of an image S1 formed on the recording medium P is uniform. Consequently, the ink volume VA1 per unit area is uniform in the entire ink ejection region 14.

On the other hand, parts outside of the ink ejection region (hereinafter, referred to as the ink ejection-free region 15) do not eject ink. That is, the ink volume VA2 per unit area in the ink ejection-free region 15 is 0.

When peeling liquid D having the same volume as the ink volume VA1 per unit area in the ink ejection region 14 is ejected in the ink ejection-free region 15. Then, the peeling liquid D is not ejected in the ink ejection region 14 (the ejection volume is 0).

Namely, let the volume of peeling liquid D per unit area in the ink ejection region 14 be VB1, and the volume of peeling liquid D per unit area in the ink ejection-free region 15 be VB2, then the control unit 13 controls so that VA1+VB1=VA2+VB2. Thus, the coating volume of "liquid" on the recording medium P can be uniform over the entire recording medium P.

Figure 4A:
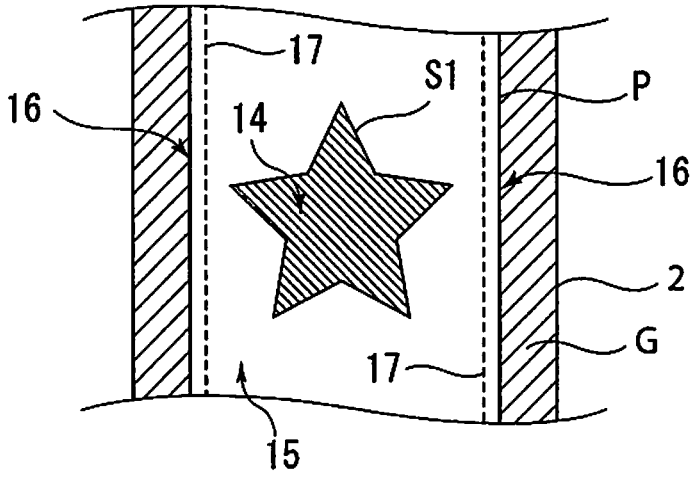
FIGS. 4A and 4B show diagrams for explaining a recording method related to an embodiment of the present invention.
Figure 4B:
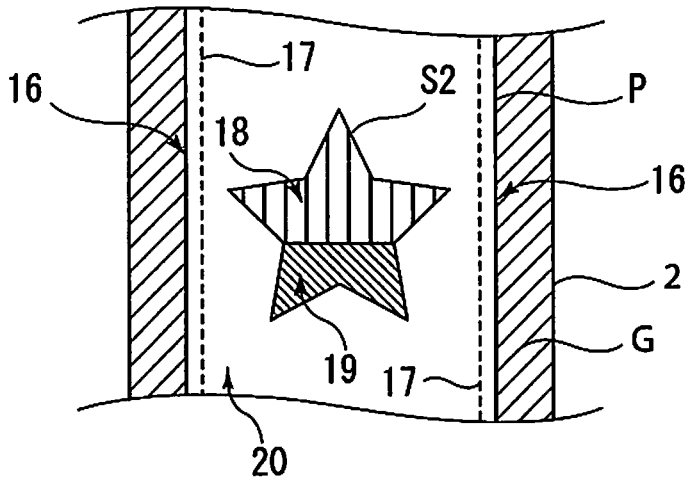

Next, FIG. 4B shows the case in which there is grayscale in image S2 formed in the recording medium P. Reference number 18 indicates a light color part. Reference number 19 indicates a dark color part. The grayscale of the image is changed by the ink ejection volume. The ink ejection volume of light color part 18 is small. The ink ejection volume of dark color part 19 is large.

In this case, the peeling liquid D adheres to the light color part 18 in which the ink ejection volume is low when the peeling liquid D is ejected to the recording medium P in order to correct the difference from the ink ejection volume in the dark color part 19.

Namely, let the ink volume in the light color part 18 be VC1, the ink volume in the dark color part 19 be VC2, and the ink volume in the ink ejection-free region 20 be VC3, and let the volume of the peeling liquid D in the light color part 18 be VD1, the volume of the peeling liquid in dark color part 19 be VD2, and the volume of the peeling liquid D in the ink ejection-free region 20 be VD3, then the control unit 13 controls so that VC1+VD1=VC2+VD2=VC3+VD3.

Thus, the coating volume of liquid on the recording medium P can be uniform over the entire recording medium P.

Here, the peeling liquid D preferably adheres to the recording medium P before image formation by the ink.

For example, a step in which the recording medium P is pressed by the adhesive roller 7 into the adhesive belt 2 and affixed thereto for support (affixing step) is performed, then a step in which the peeling liquid D is ejected and adhered to the recording medium P supported by the adhesive belt 2 (peeling liquid adhesion step) is performed. Following the peeling liquid adhesion step, the step in which the ink is ejected to form the image (image formation step) is performed.

By performing the peeling liquid adhesion step before image formation step in this way, the peeling liquid D adheres to the front of the recording medium P, and the ink is able to easily penetrate the recording medium P.

For example, as in FIG. 3A, when the nozzle array 11*a* that ejects the peeling liquid D and the nozzle arrays 10*a*, 10*b*, 10*c*, 10*d* that eject each of the colored inks (Y, M, C, K) are provided in one ejection head 6, peeling liquid adhesion step followed by the image formation step can be performed so that the peeling liquid D is ejected in the outgoing path of the reciprocating motion of the ejection head 6, and ink is ejected during the motion of the return path.

Thus, in the width direction of the recording medium P (X direction in FIG. 2 and FIGS. 3A and 3B), it is possible to be in a state in which there is almost no time lag in the adhesion of peeling liquid D and the adhesion of ink, and the penetration states of the liquids in the recording medium P can be more uniform. Namely, it is possible for the adhesive force of the peeling parts to be simultaneously identical at the peeling position 12.

In addition, when the nozzle array 11*a* that ejects the peeling liquid D is arranged in the end part on the advancing direction side of the ejection head 6, the peeling liquid adhesion step followed by the image formation step can be performed during the interval when the ejection head 6 moves in the advancing direction.

Figure 3B:
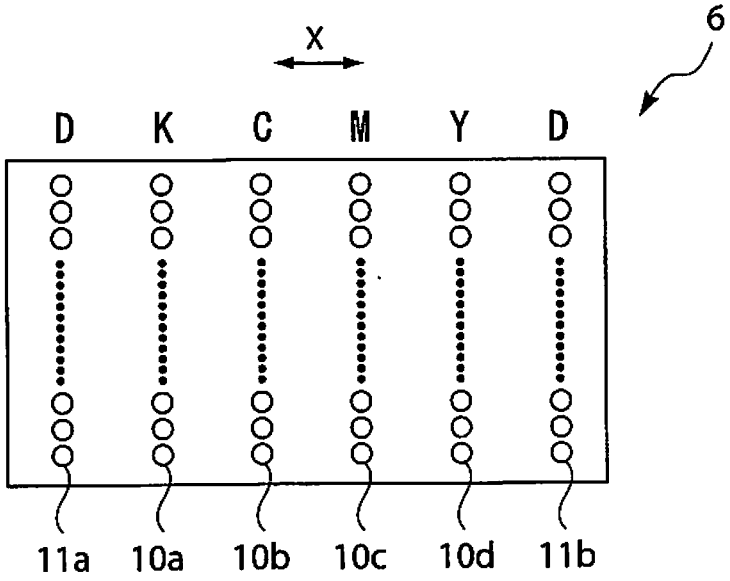
FIG. 3B is a plan view of another example of an ejection head.

As shown in FIG. 3B, the ejection head 6 may be provided with the nozzle arrays 10*a*, 10*b*, 10*c*, 10*d* that eject each of the colored inks (Y, M, C, K), and the nozzle array 11*a* and nozzle array 11*b* that eject the peeling liquid D and are provided at both ends in order to sandwich the nozzle arrays of the colored inks.

By arranging the nozzle arrays in this way, the operations of the peeling liquid adhesion step followed by the image formation step while the ejection head 6 moves in one direction can be in either of the outgoing path and the return path of the reciprocating motion of the ejection head 6.

In addition, preferably, the peeling liquid D adheres to at least the side edges 16 of the recording medium P. For example, preferably, the peeling liquid D is ejected into the region on the side edges 16 from the dotted line 17 in FIG. 4A or FIG. 4B.

When the recording medium P is cloth or paper, sometimes the fibers in the cloth or the paper emerge as a nap. The nap of the fibers of the side edges 16 of the recording medium P easily remains sticking to the adhesive belt 2.

For example, as shown in FIG. 4A and FIG. 4B, there is often no recording at the side edges 16 of the recording medium P in a recording apparatus that records on cloth as in an inkjet print recording apparatus.

In the recording medium P supported by the adhesive belt 2, the parts having a small amount of penetration of the "liquid" has stronger adhesive force between the adhesive belt 2 and the recording medium P than parts having a large amount of penetration of the "liquid."

Consequently, by adhering the peeling liquid D to the side edges 16 of the recording medium P, the adhesive force near the side edges 16 can be reduced. Thus, when the recording medium P is peeled from the adhesive belt 2, nap remaining on the adhesive belt 2 can be effectively prevented.

Thus, the present invention is not limited to the above working examples, and needless to say, can have various modifications that are within the scope of the invention described within the scope of the patent claims and also be included within the scope of the present invention.

Specific working examples of the present invention were described in detail above. Here, the present invention is summarized again.

The recording apparatus 1 related to a first embodiment of the present invention is provided with an adhesive belt 2 having adhesion to peelable affix the recording medium P, a liquid ejection unit 10 that ejects the liquid for forming an image through nozzle arrays 10*a*, 10*b*, 10*c*, 10*d* on a recording medium P supported by the adhesive belt 2, and a peeling liquid adhesion unit 11 that adheres a peeling liquid D to the recording medium P.

Here, the "adhesive belt" means a belt that has an adhesive agent coated on the support surface G of the recording medium P and the support surface G has adhesion to peelably affix the recording medium P.

In addition, the "peeling liquid" adheres to the recording medium P and imparts peelability from the adhesive belt 2 to the recording medium P.

According to this embodiment, because the peeling liquid adhesion unit 11 for adhering the peeling liquid D to the recording medium P is provided, the volume of liquid, for example, ink, for forming the image that is ejected onto the recording medium P differs for each part of the recording medium P and is distributed into parts having a low coating volume of ink and parts having a high coating volume, the peeling liquid D is adhered to the parts having a low coating volume of ink, and the difference in the volume of "liquid" in the parts having a high coating volume of ink can be made small.

When the difference in the coating volume of the "liquid" becomes small between parts having a large coating volume of ink and parts having a small coating volume, the difference in the penetration state of the liquid at the interface of the adhesive belt 2 and the recording medium P becomes small. Thus, concern can be lessened about a difference developing in the adhesive force between the adhesive belt 2 and the recording medium P.

Thus, when the recording medium P after the ink is ejected is peeled from the adhesive belt 2, the parts having a low coating volume of ink can be prevented from becoming difficult to peel off.

The recording apparatus 1 related to a second embodiment of the present invention is the first embodiment in which the peeling liquid adhesion unit 11 has the same structure as the liquid ejection unit 10.

According to this embodiment, the peeling liquid adhesion unit 11 has the same structure as the liquid ejection unit 10, and the peeling liquid D can be ejected in the same droplet state as a liquid and adhere to the recording medium P.

The recording apparatus 1 related to a third embodiment of the present invention is the second embodiment in which a control unit 13 is provided to control the operations of the liquid ejection unit 10 and the peeling liquid adhesion unit 11. This control unit 13 controls the ejection volume of liquid from the liquid ejection unit 10 and the ejection volume of peeling liquid D from the peeling liquid adhesion unit 11 to be the same as the total volume of liquid ejected per unit area onto the entire recording medium P.

According to this embodiment, the coating volume as a "liquid" that combines the liquid for forming the image and the peeling liquid D can be uniform over the entire recording medium P. Thus, the penetration state of "liquid" at the interface between the adhesive belt 2 and the recording medium P can be uniform, and concern can be lessened about a difference developing in the adhesive force between the adhesive belt 2 and the recording medium P. Thus, after the liquid is ejected onto the recording medium P, the difficulty in partially peeling the recording medium P from the adhesive belt 2 can be reduced.

The "same" total volume of liquid ejected per unit area on the entire recording medium P is not limited to the case of a completely identical volume, and includes the meaning "same" in which the adhesive force between the adhesive belt 2 and the recording medium P may be nearly equal and is within the range in which a difference is not produced in the ease of peeling.

The recording apparatus 1 related to a fourth embodiment of the present invention is any one of the first embodiment to the third embodiment in which the configuration is such that the peeling liquid D is adhered to the recording medium P after the recording medium P is supported by the adhesive belt 2.

According to this embodiment, because the peeling liquid D for the supported recording medium P adheres to the recording medium P on the adhesive belt 2, the adhesion of the peeling liquid D can be in the same support state as the recording medium when the liquid ejected from the liquid ejection unit 10 adheres. In addition, the recording medium P readily adheres to the adhesive belt 2 before the peeling liquid D is adhered.

The recording apparatus 1 related to a fifth embodiment of the present invention is any one of the first embodiment to the third embodiment in which the peeling liquid D adheres to parts outside of the liquid ejection region.

According to this embodiment, by adhering the peeling liquid D to parts outside of the liquid ejection region, namely the ink ejection-free region 15, the difference in the coating volume of "liquid" in the ink ejection region 14 and the ink ejection-free region 15 can be decreased, and the coating volume of "liquid" for the entire recording medium P can be nearly equal.

Thus, the difference in the penetration states of the "liquid" at the interface between the adhesive belt 2 and the recording medium P can be small over the entire recording medium P. In addition, concern can be lessened about a difference developing in the adhesive force between the adhesive belt 2 and the recording medium P.

The recording apparatus 1 related to a sixth embodiment of the present invention is any one of the first embodiment to the fifth embodiment in which the peeling liquid D adheres to at least the side edges 16 of the recording medium P.

When the recording medium P is cloth or paper, the fibers of the cloth or the paper may sometimes form a nap at the side edges 16. The nap of fibers at the side edges 16 on this recording medium P easily remains stuck to the adhesive belt 2.

In addition, when an image is formed, there is often no recording at the side edges 16 of the recording medium P.

Here, parts with a low amount of penetration of "liquid" in the recording medium P supported by the adhesive belt 2 has a higher adhesive force between the adhesive belt 2 and the recording medium P than parts having a high amount of penetration of "liquid."

According to this embodiment, by adhering the peeling liquid D to at least the side edges 16 of the recording medium P, the adhesive force in the side edges 16 can be lower. Thus, when the recording medium P is peeled from the adhesive belt 2, the nap of the side edges 16 of the recording medium P can be effectively prevented from remaining on the adhesive belt 2.

The recording apparatus 1 related to the seventh embodiment of the present invention is any one of the first embodiment to the sixth embodiment in which the peeling liquid D includes water and a surfactant.

According to this embodiment, a liquid including water and a surfactant is used as the peeling liquid D and can obtain the same effects as any one of the first embodiment to the sixth embodiment.

A recording method related to an eighth embodiment of the present invention is provided with a step that adheres the peeling liquid D onto the recording medium P and a step in which a liquid is ejected onto the recording medium P supported by the adhesive belt 2 to form an image.

According to this embodiment, because the step in which the peeling liquid D is adhered to the recording medium P, effects similar to the first embodiment can be obtained.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A recording apparatus comprising:

an adhesive belt that has adhesion to peelably affix a recording medium;

a liquid ejection head configured to eject a liquid forming an image from a nozzle array onto the recording medium supported by the adhesive belt;

a peeling liquid adhesion unit including a peeling liquid nozzle array configured to eject a peeling liquid onto the recording medium; and a control unit configured to control operations of the liquid ejection head and the peeling liquid adhesion unit, the control unit being configured to control such that a total liquid volume that combines a volume of liquid ejected per unit area of the recording medium from the liquid ejection unit and a peeling liquid ejection volume per unit area of the recording medium from the peeling liquid adhesion unit becomes a predetermined volume.

2. The recording apparatus according to claim 1, wherein the peeling liquid adhesion unit is configured to adhere the peeling liquid onto the recording medium after the recording medium has been supported by the adhesive belt.

3. The recording apparatus according to claim 1, wherein the peeling liquid adheres to a part outside of a liquid ejection region.

4. The recording apparatus according to claim 1, wherein the peeling liquid includes water and a surfactant.

5. The recording apparatus according to claim 1, wherein the nozzle array and the peeling liquid nozzle array are provided in a single ejection head.

6. The recording apparatus according to claim 5, wherein the nozzle array extends along a transport direction of the adhesive belt, and the peeling liquid nozzle array extends parallel to the nozzle array.

7. The recording apparatus according to claim 6, wherein the peeling liquid nozzle array is disposed outwardly of the nozzle array in the ejection head with respect to a direction intersecting the transport direction.

8. The recording apparatus according to claim 1, wherein the peeling liquid adhesion unit is configured to adhere the peeling liquid, which does not contain colorings.

9. The recording apparatus according to claim 1, wherein the peeling liquid adheres to at least a side edge of the recording medium.

* * * * *